US012298055B2

(12) United States Patent
Moon et al.

(10) Patent No.: US 12,298,055 B2
(45) Date of Patent: May 13, 2025

(54) REFRIGERATOR

(71) Applicant: LG Electronics Inc., Seoul (KR)

(72) Inventors: Kyungroc Moon, Seoul (KR); Jaekeun Lee, Seoul (KR); Youngmin Park, Gyeongsangnam-do (KR); Jongpil Park, Busan (KR)

(73) Assignee: LG Electronics Inc., Seoul (KR)

( * ) Notice: Subject to any disclaimer, the term of this patent is extended or adjusted under 35 U.S.C. 154(b) by 298 days.

(21) Appl. No.: 17/914,524

(22) PCT Filed: Mar. 26, 2021

(86) PCT No.: PCT/KR2021/003797

§ 371 (c)(1),
(2) Date: Sep. 26, 2022

(87) PCT Pub. No.: WO2021/194313

PCT Pub. Date: Sep. 30, 2021

(65) Prior Publication Data

US 2023/0145778 A1 May 11, 2023

(30) Foreign Application Priority Data

Mar. 27, 2020 (KR) ..... 10-2020-0037855

(51) Int. Cl.
*F25D 21/14* (2006.01)

(52) U.S. Cl.
CPC ..... *F25D 21/14* (2013.01); *F25D 2321/1412* (2013.01)

(58) Field of Classification Search
CPC ..... F25D 17/045; F25D 21/006; F25D 21/12; F25D 21/14; F25D 2321/1412
See application file for complete search history.

(56) References Cited

U.S. PATENT DOCUMENTS

2017/0248360 A1* 8/2017 Tao ..... F25D 21/12

FOREIGN PATENT DOCUMENTS

CN 206257857 6/2017
JP 2001041636 2/2001
(Continued)

OTHER PUBLICATIONS

Extended European Search Report in European Appln. No. 21776785.4, mailed on Mar. 11, 2024, 8 pages.
(Continued)

*Primary Examiner* — Henry T Crenshaw
(74) *Attorney, Agent, or Firm* — Fish & Richardson P.C.

(57) ABSTRACT

A refrigerator includes a grille fan assembly provided behind a storage space and shielding an evaporator, and a machine room independent of the storage space. The grille fan assembly includes a case with an open front, a fan configured to force an air flow between the storage space and the heat exchange space, a grille panel shielding the open front of the case and having a discharge port for discharging cold air to the storage space and a suction port for suctioning air from the storage space, a partition dividing of the case into a cold air flow space and a heated air flow space, an exhaust member extending from the case to the machine room and communicating an inside of the case with of the machine room, and a machine room exhaust damper configured to open and close the exhaust member.

20 Claims, 10 Drawing Sheets

(56) References Cited

FOREIGN PATENT DOCUMENTS

| | | |
|---|---|---|
| KR | 10-2001-0061670 | 7/2001 |
| KR | 20020038393 | 5/2002 |
| KR | 10-2008-0079109 | 8/2008 |
| KR | 20100085228 | 7/2010 |
| KR | 10-2011-0085597 | 7/2011 |
| KR | 101658233 | 9/2016 |
| KR | 101660045 | 9/2016 |
| KR | 20180035622 | 4/2018 |
| KR | 10-2018-0124451 | 11/2018 |

OTHER PUBLICATIONS

Notice of Allowance in Korean Appln. No. 10-2020-0037855, mailed on Dec. 13, 2023, 6 pages (with English translation).

* cited by examiner

REFRIGERATOR

CROSS-REFERENCE TO RELATED APPLICATIONS

This application is a National Stage application under 35 U.S.C. § 371 of International Application No. PCT/KR2021/003797, filed on Mar. 26, 2021, which claims the benefit of Korean Patent Application No. 10-2020-0037855, filed on Mar. 27, 2020. The disclosures of the prior applications are incorporated by reference in their entirety.

TECHNICAL FIELD

The present disclosure relates to a refrigerator.

BACKGROUND ART

In general, a refrigerator is a home appliance that can store food at a low temperature in an internal storage space that is shielded by a door. To this end, the refrigerator is configured to store the stored food in an optimal state by cooling the inside of the storage space using cold air generated through heat exchange with the refrigerant circulating in the refrigeration cycle.

Recently, refrigerators are gradually becoming larger and multifunctional according to changes in dietary habits and the trend of luxury products and a refrigerator having various structures and convenient devices for user convenience and efficient use of internal space has been released.

When the refrigerator is operated for a long period of time, wet air flowing thereinto from the outside may form frost in the inner area of the refrigerator, especially in a location adjacent to the evaporator, and when the frost is grown, the heat exchange efficiency of the evaporator may decrease or the cooling performance in the refrigerator may be rapidly deteriorated by blocking the cold air flow path.

In order to solve this problem, a refrigerator is developed that disposes a defrost heater in a position adjacent to the evaporator, and, when a set condition for frost formation is satisfied, operates the defrost heater to remove the frost at the evaporator and in the region adjacent to the evaporator.

Representatively, Korea Registered Patent No. 10-1658233 discloses a refrigerator that determines an operation time of a defrost heater by detecting a change in a temperature in a refrigerator and an evaporator temperature to determine an accurate defrost time.

In addition, Korea Registered Patent No. 10-166045 discloses a refrigerator in which a heating portion for defrosting is operated by determining the amount of frost adhesion through a photographed image of a photographing apparatus for photographing an evaporator.

As described above, a refrigerator capable of minimizing power consumption by determining an appropriate defrosting time to operate a defrost heater is being developed.

However, all of these conventional techniques are to heat an evaporator with a very low temperature or a region adjacent to the evaporator, and in order to melt the frost, the heater must be heated to a high temperature for a sufficient time to dissolve the frost, thereby increasing the temperature in the entire refrigerator and thus there is a problem in that the operation of the compressor for cooling the inside of the refrigerator again becomes longer and thus power consumption increases.

In addition, there is a problem in that power consumption increases even when the defrost heater is operated for removing the frost.

DISCLOSURE

Technical Problem

An object of an embodiment of the present disclosure is to provide a refrigerator capable of performing a defrosting operation while minimizing a temperature change in a storage space.

An object of an embodiment of the present disclosure is to provide a refrigerator capable of improving defrosting operation efficiency by reducing a defrosting operation time.

An object of an embodiment of the present disclosure is to provide a refrigerator capable of reducing power consumption by minimizing the operation of a defrosting heater.

Technical Solution

A refrigerator according to an embodiment of the present disclosure may include a cabinet forming a storage space; a machine room provided with a compressor and a condenser; a grill pan assembly provided in the storage space and configured to shield the evaporator from the front; and an air suction member configured to communicate the heat exchange space in which the evaporator is disposed and the machine room; in which the grill pan assembly may include a case configured to communicate with the heat exchange space; a fan provided in the case; a grill pan provided on the front surface of the case and having a cold air discharge port and a cold air suction port; an exhaust member configured to communicate the case and the machine room; an exhaust damper provided in the case and configured to open and close the exhaust member; and a partition provided inside the case, and the partition may partition the inside of the case into a first space forming a flow path of cold air circulating between the heat exchange space and the storage space and a second space forming a flow path of heating air circulating between the machine room and the heat exchange space.

Based on the partition, the first space may be formed in the front, and the second space is formed in the rear.

The case may include a case plate forming a rear surface; and a case flange configured to extend forward along the circumference of the case plate, and in which a flow path forming portion spaced apart from the case flange and protruding to a lower height than the case flange to be shielded by the partition may be formed in the case plate.

The fan may be positioned inside the flow path forming portion.

The partition may be formed in a shape corresponding to the flow path forming portion and may be coupled to an end portion of the flow path forming portion to shield the second space.

The exhaust damper may maintain a closed state during a cooling operation in which the compressor is driven and may be opened during a defrosting operation for defrosting of the evaporator.

The partition may be provided with a discharge damper configured to selectively communicate the first space and the second space, and the discharge damper may be closed during the defrosting operation and opened during the cooling operation.

The case may be provided with a suction damper configured to open and close the suction port, and the suction damper may be closed during the defrosting operation and opened during the cooling operation.

A machine room fan configured to cool the compressor and the condenser may be provided in the machine room, the machine room fan may be driven during the defrosting operation, and the inlet of the air suction member may be positioned on the discharge side of the machine room fan, and the outlet of the exhaust member is positioned on the suction side of the machine room fan.

During the defrosting operation, both the fan and the machine room fan may be driven.

The partition may have a discharge flow path portion formed at a position corresponding to the exhaust damper and guiding air flow to the exhaust damper.

The partition may be provided with a discharge damper, when the fan is driven while the discharge damper is open, the cold air generated by the evaporator may pass through the first space and the storage space and flow into the heat exchange space, and when the fan is driven while the discharge damper is closed, the air in the machine room may flow into the machine room through the evaporator and the second space.

The air suction member may extend toward the defrost water receiver on the floor of the machine room.

The exhaust member may be formed to communicate with the second space and the machine room.

The outlet of the exhaust member may be positioned above the condenser.

In another aspect, a refrigerator according to an embodiment of the present disclosure may include a cabinet forming a storage space; an evaporator provided in the storage space; a grill pan assembly provided in the storage space and forming a heat exchange space in which the evaporator is accommodated; a fan for circulating air between the heat exchange space and the storage space; a machine room forming a space independent of the storage space and having a compressor and a condenser; a machine room fan provided in the machine room and operated to cool the compressor and the condenser; an air suction member connecting the machine room and the heat exchange space and forming a passage through which air from the machine room is suctioned into the heat exchange space; an exhaust member connecting the machine room and the heat exchange space and forming a passage through which air in the heat exchange space is discharged to the machine room; and a machine room exhaust damper configured to open and close the exhaust member.

In addition, in another aspect, the refrigerator according to an embodiment of the present disclosure may include a cabinet forming a storage space; a grill fan assembly partitioning the storage space to form a heat exchange space in which the evaporator is accommodated; a machine room forming a space independent of the storage space and having a compressor and a condenser; and a drain hose extending from the heat exchange space to the inside of the machine room to discharge defrost water generated during the defrosting operation toward the machine room, in which the grill fan assembly may include a case having an open front and forming an air flow space therein; a fan provided in the case and configured to force an air flow between the storage space and the heat exchange space; a grill fan shielding the open front of the case to form one surface of the storage space, and having a cold air discharge port for discharging cold air to the storage space and a cold air suction port for suctioning air from the storage space; an exhaust member extending from one side of the case into the machine room and communicating the air flow space and the inside of the machine room; and a machine room exhaust damper for opening and closing the exhaust member from one side of the exhaust member.

Advantageous Effect

According to the refrigerator according to the embodiment of the present disclosure, the following effects can be expected.

During the defrosting operation, the air in the machine room flows into the heat exchange space in which the evaporator is disposed, and an air circulation structure is provided between the heat exchange space and the machine room so that effective defrosting can be achieved.

In particular, the high temperature air inside the machine room can melt the frost on the air flow path including the evaporator and the heat exchange space, so that the defrost heater is not used or the use of the defrost heater is minimized so that the defrost operation can be performed, and thus there is an advantage of significantly reducing power consumption.

Then, the inside of the grill pan assembly is partitioned into a cold air flow space and a heated air flow space, and the operation of the dampers is adjusted during the defrosting operation and thus only the air flows between the machine room and the heated air flow space to be capable of performing the defrosting operation. At this time, the efficiency of the defrosting operation can be improved by preventing the infiltration of high-temperature air into the cold air flow space and the storage space by switching the dampers, and the temperature of the storage space can be prevented from increasing during the defrosting operation.

In addition, by driving the machine room fan, the air inside the machine room is supplied to the heat exchange space, and the air in the heat exchange space can be discharged to the machine room, and thus there is an advantage of implementing a machine room air supply structure with minimal additional configuration.

In addition, air from the machine room is suctioned through the drain hose from which the defrost water is discharged, and the air from the heat exchange space is discharged through an exhaust member communicating with the grill pan assembly and the machine room, so that the existing structure is utilized to the maximum extent and thus there is an advantage that can implement an air circulation structure between the inside of the machine room and the heat exchange space.

In particular, the drain hose and the exhaust member are disposed on the suction side and the discharge side of the machine room fan, respectively, and thus there is an advantage in that air can be circulated between the heat exchange space and the machine room by using the rotation of the machine room fan without adding a separate fan.

In addition, there is an advantage in that the fan in the refrigerator is driven together with the machine room fan, so that air circulation between the machine room and the heat exchange space is made more effectively, and thus the defrosting operation can be effectively performed.

BEST MODE

Figure 1:
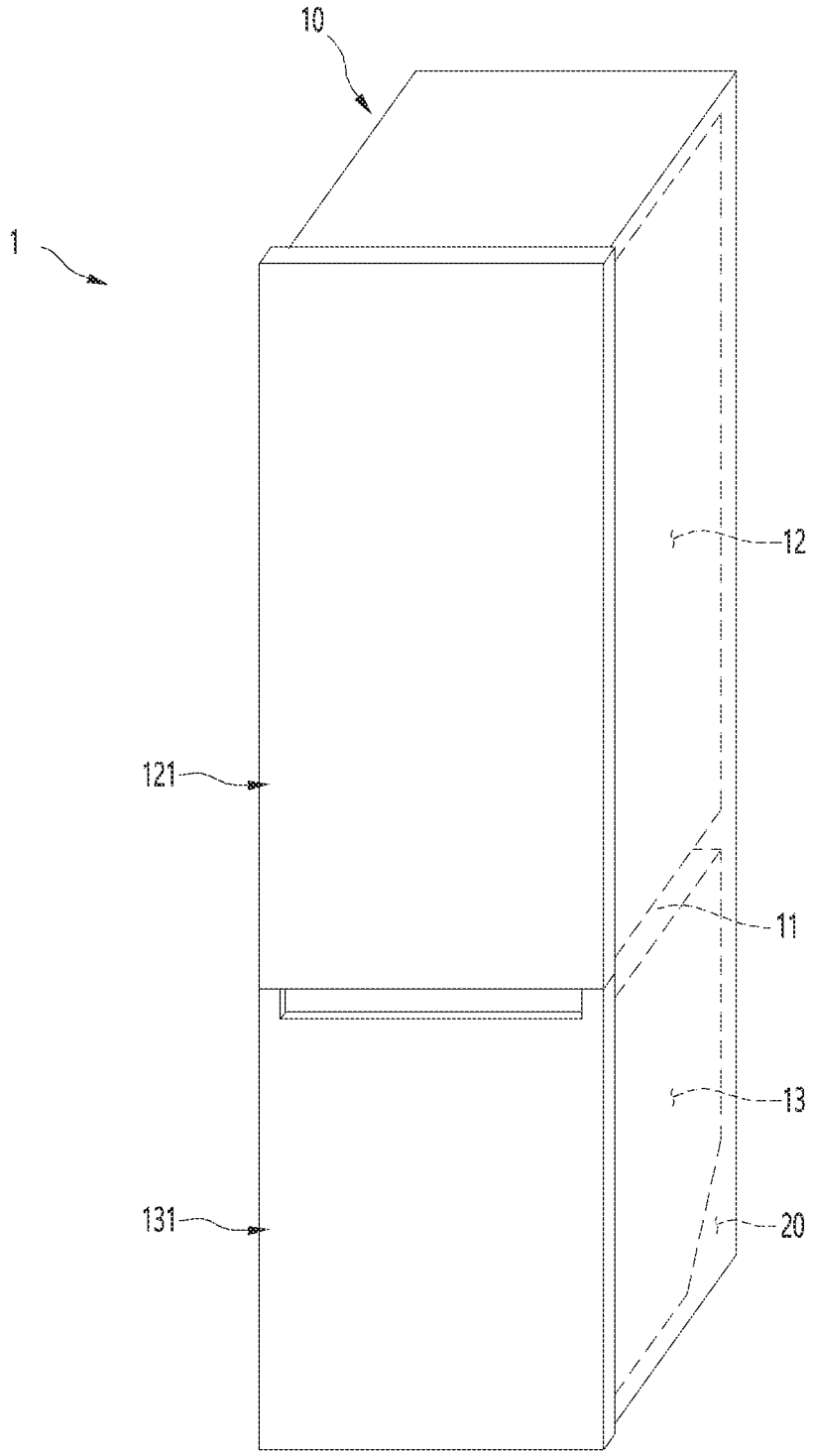
FIG. 1 is a perspective view illustrating a refrigerator according to an embodiment of the present disclosure.

Hereinafter, some embodiments of the present disclosure will be described in detail with reference to exemplary drawings. In adding reference numerals to the components of each drawing, it should be noted that the same components are given the same reference numerals as much as possible even though they are indicated on different drawings. In addition, in describing an embodiment of the present disclosure, a detailed description of a related known configuration or a function thereof will be omitted if it is determined that it is obvious to those skilled in the art.

In addition, the embodiment of the present disclosure will be described as an example of a bottom freeze type refrigerator in which a freezing chamber is provided below, for convenience of explanation and understanding, and it should be noted in advance that the present disclosure is not limited to the shape of the refrigerator and can be applied to various types of refrigerators.

For the convenience of explanation and understanding, the direction is defined. Hereinafter, with respect to the bottom surface on which the refrigerator is installed, a direction toward the bottom surface may be referred to as a down direction, and a direction which is opposite to the down direction and is toward the high surface of the cabinet may be referred to as an up direction. In addition, a direction toward the door may be referred to as a front direction, and a direction toward the inside of the cabinet with respect to the door may be referred to as a rear direction. In addition, when an undefined direction is discussed, the direction may be defined and explained based on each drawing.

Figure 2:
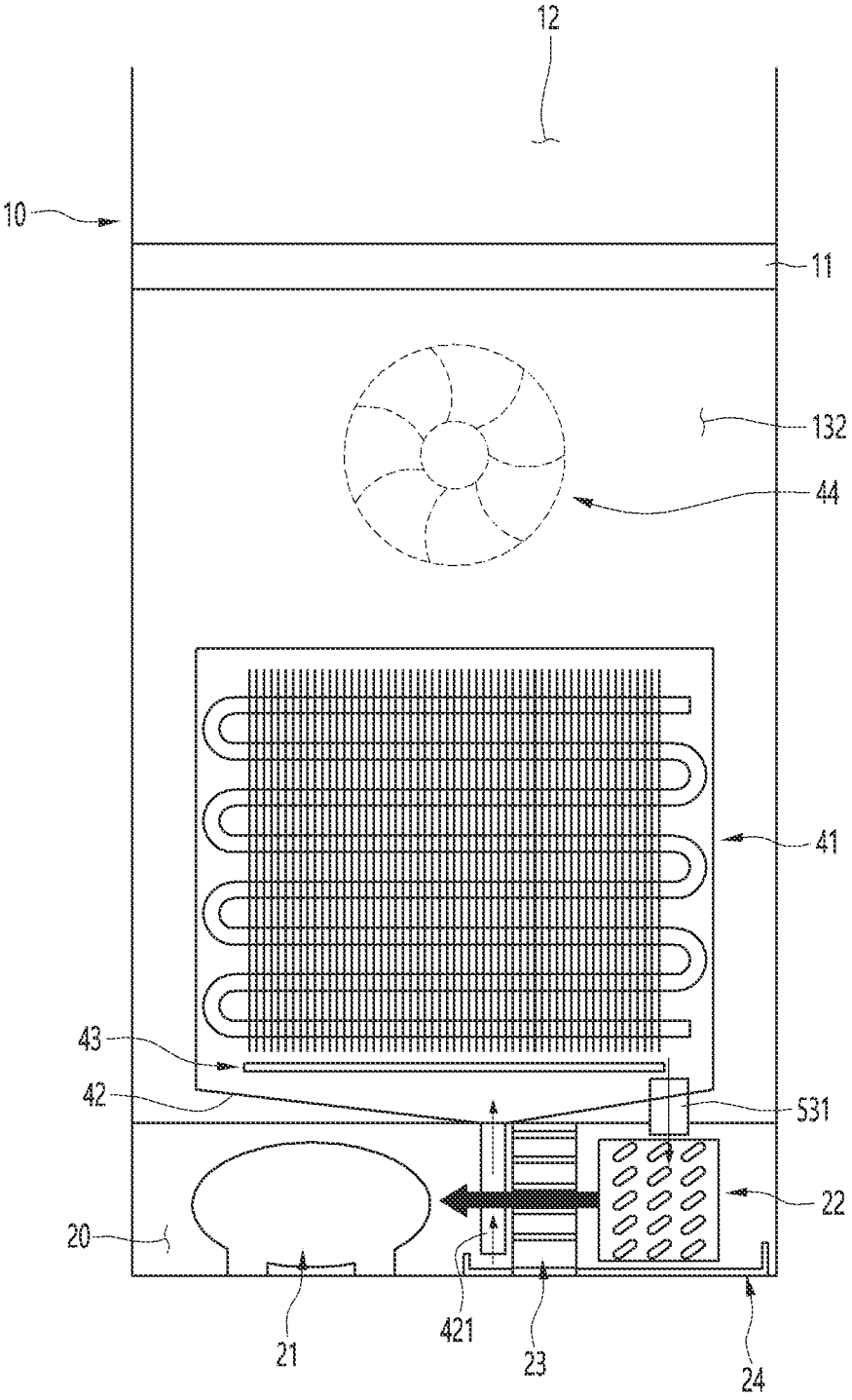
FIG. 2 is a diagram schematically illustrating a disposition state of a machine room and a heat exchange space of the refrigerator.
Figure 3:
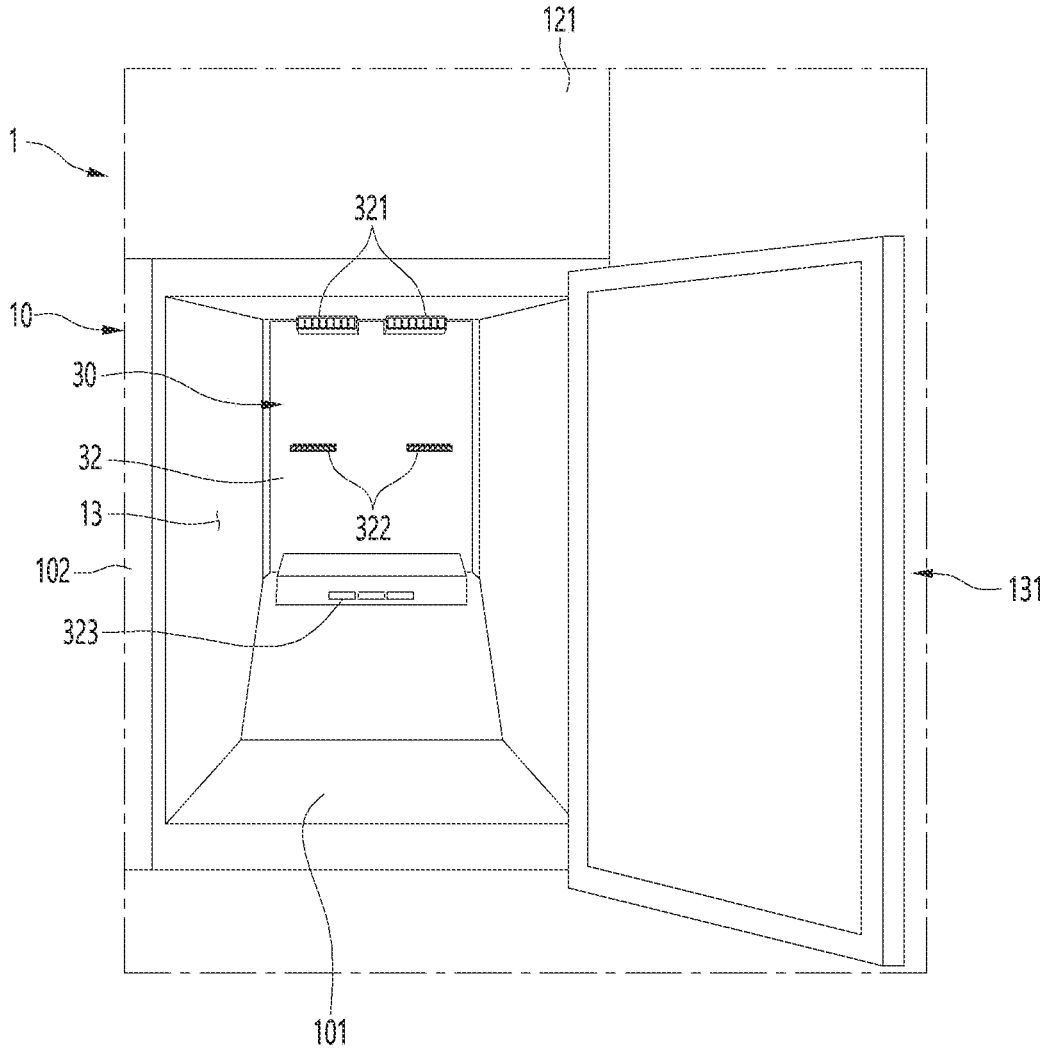
FIG. 3 is a partial perspective view illustrating a state where the door of the refrigerator is opened.

FIG. 1 is a perspective view illustrating a refrigerator according to an embodiment of the present disclosure, FIG. 2 is a diagram schematically illustrating a disposition state of a machine room and a heat exchange space of the refrigerator, and FIG. 3 is a partial perspective view illustrating a state where the door of the refrigerator is opened.

As illustrated in the drawing, the refrigerator 1 according to the embodiment of the present disclosure may have an overall outer appearance formed by a cabinet 10 forming a storage space and doors 121 and 131 opening and closing the storage space.

The cabinet 10 may include an outer case 102 forming an outer appearance and an inner case 101 forming a storage space. In addition, an adiabatic material 103 may be filled in the region spaced apart from each other between the outer case 102 and the inner case 101.

The storage space inside the cabinet 10 may be partitioned up and down by a barrier 11, and the refrigerating chamber 12 may be formed at the upper side and the freezing chamber 13 may be formed at the lower side. Since the refrigerating chamber 12 is disposed above, the refrigerating chamber may be referred to as an upper storage space or a first storage space. In addition, since the freezing chamber 13 is disposed below, the freezing chamber may be referred to as a lower storage space or a second storage space.

The doors 121 and 131 form a front surface of the refrigerator 10 and may be rotatably mounted to the cabinet 10. The doors 121 and 131 may include a refrigerating chamber door 121 for opening and closing the refrigerating chamber 12 and a freezing chamber door 131 for opening and closing the freezing chamber 13.

In addition, the machine room 20 may be formed in a corner region including a portion of the rear surface and the lower surface of the cabinet 10. The machine room 20 may be configured such that a compressor 21 and a condenser 22 constituting a refrigeration cycle for cooling the storage space may be disposed. In addition, an evaporator 41 may be disposed in the heat exchange space 132 to be described below.

In detail, a compressor 21 for compressing the refrigerant at high temperature and high pressure and a condenser 22 for condensing the refrigerant at high temperature and high pressure supplied from the compressor 21 may be provided in the machine room 20.

At least a portion of the machine room 20 may be opened, and external air may flow therein and air inside the machine room 20 may be discharged. In addition, a machine room fan 23 may be provided inside the machine room 20, and cooling of the compressor 21 and heat dissipation of the condenser 22 may be performed by driving the machine room fan 23.

The machine room fan 23 may be disposed between the compressor 21 and the condenser 22, and the machine room fan 23 may force the air flow in the internal space of the machine room 20 partitioned in the left and right direction. For example, the air outside the machine room 20 may flow into the machine room 20 by the driving of the machine room fan 23 and may radiate heat from the condenser 22 while passing through the condenser 22. Then, the air passing through the condenser 22 passes through the machine room fan 23 and then passes through the compressor 21 to cool the compressor 21. The air cooled by the compressor 21 may be discharged to the outside of the machine room 20.

The evaporator 41 may be disposed on the rear side of the freezing chamber 13. The evaporator 41 may be disposed in a heat exchange space 132 formed between the grill pan assembly 30 and the inner case 101 when a grill pan assembly 30 to be described below is mounted.

In addition, a water collection member 42 having an inclination is provided on a lower surface of the heat exchange space 132 to collect water falling from the evaporator 41 during a defrosting operation. In addition, the water collection member 42 may be provided with a drain hose 421 extending toward the defrost water receiver 24 inside the machine room 20 through the upper surface of the machine room 20. Accordingly, water that has fallen to the water collection member 42 by the defrosting operation may be discharged to the defrost water receiver 24 provided in the machine room 20 through the drain hose 421.

Meanwhile, the drain hose 421 may be a passage through which air inside the machine room 20 flows into the heat exchange space 132 during a defrosting operation. At this time, the drain hose 421 may be positioned on the side of the compressor 21 with respect to the machine room fan 23, so that the air forced by the machine room fan 23 flows into the inside of the heat exchange space 132 through the drain hose 421. Since the drain hose 421 serves as a passage through which the air inside the machine room 20 flows into the heat exchange space 132, the drain hose may be referred to as an inlet passage or an air suction member.

In addition, the exhaust member 531 may be provided on the side of the condenser 22 with respect to the machine room fan 23. The exhaust member 531 is formed to connect between the upper surface of the machine room 20 and the bottom surface of the heat exchange space 132, and the air in the heat exchange space 132 can be discharged to the machine room 20. In particular, when the machine room fan 23 is driven, a negative pressure may be generated on the condenser 22 side, and thus the air in the heat exchange space 132 can be discharged into the machine room 20 through the exhaust member 531. In addition, the exhaust member 531 serves as a passage through which air is discharged and thus may be referred to as an exhaust passage.

Meanwhile, a defrost heater 43 may be provided at one side of the evaporator 41. For example, the defrost heater 43 may be provided at the lower side or at the lower end of the evaporator 41. The defrost heater 43 may be formed to have a smaller size or a smaller capacity than a general defrost heater 43. In addition, if the defrosting can be sufficiently performed using the air inside the machine room 20, the defrost heater 43 may be omitted.

A fan 44 in the refrigerator may be provided above the evaporator 41. The cold air generated in the evaporator 41 by driving the fan 44 in the refrigerator may be supplied to the freezing chamber 13 and the refrigerating chamber 12. Meanwhile, the fan 44 in the refrigerator may force air circulation between the machine room 20 and the heat exchange space 132 during a defrosting operation. In addition, the fan 44 in the refrigerator may be provided in the grill pan assembly 30 for guiding the flow of cold air generated by the evaporator 41.

The grill pan assembly 30 may partition the inner space of the freezing chamber 13 in the front and rear direction. In other words, the grill pan assembly 30 may partition the internal space of the freezing chamber 13 into a space in which food is stored and the heat exchange space 132 in which the evaporator 41 is disposed.

A front surface of the grill pan assembly 30 forms a rear wall surface of a space of the freezing chamber 13, in which food is stored. In addition, cold air discharge ports 321 and 322 for discharging cool air to the inside of the refrigerator and cold air suction port 323 for suctioning cool air in the refrigerator toward the evaporator 41 may be formed on the front surface of the grill pan assembly 30.

In addition, the fan 44 in the refrigerator may be provided inside the grill pan assembly 30, and a passage through which cold air may flow may be formed. In addition, a plurality of dampers 51, 52, 53, 54 for opening and closing the flow path may be provided to supply cold air to various paths according to the driving state. In addition, the rear surface of the grill pan assembly 30 may shield the heat exchange space 132 in which the evaporator 41 is disposed.

Hereinafter, the structure of the grill pan assembly 30 will be described in more detail with reference to the drawings.

Figure 4:
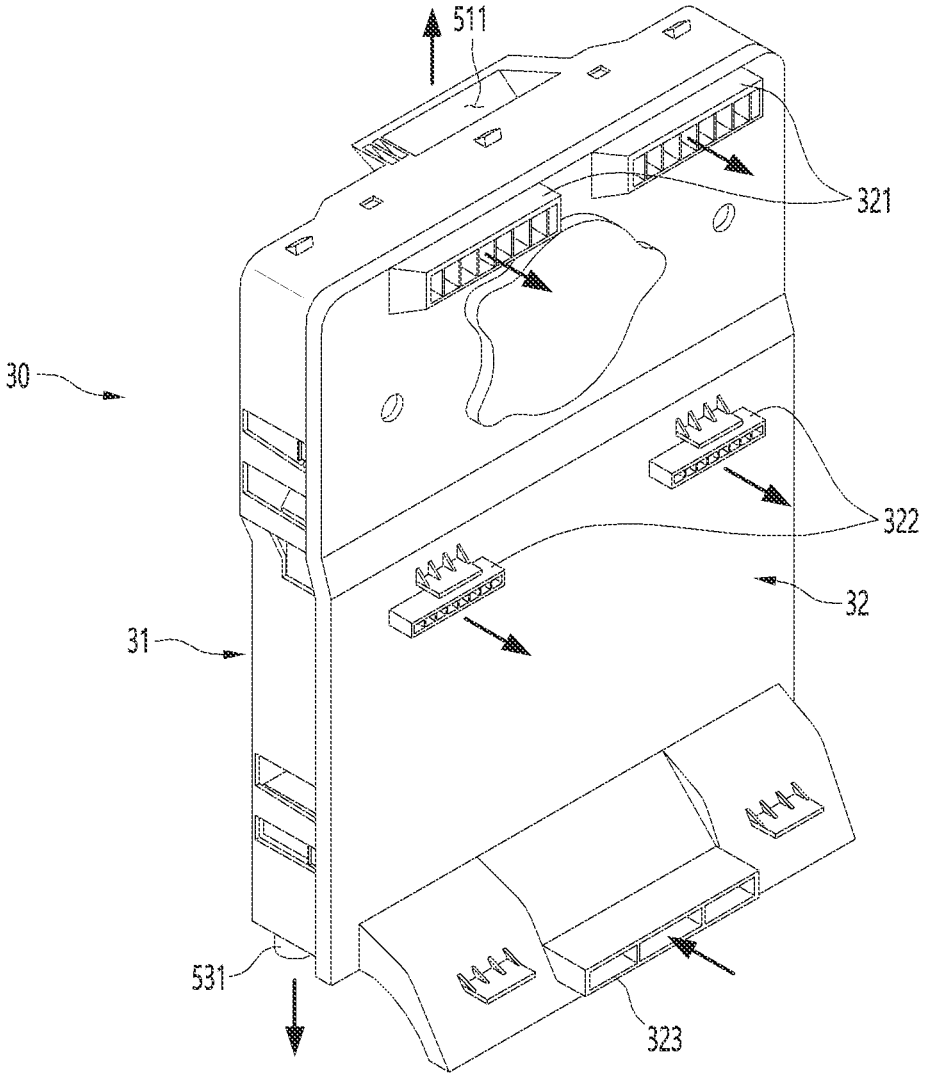
FIG. 4 is a perspective view illustrating a grill pan assembly of the refrigerator.
Figure 5:
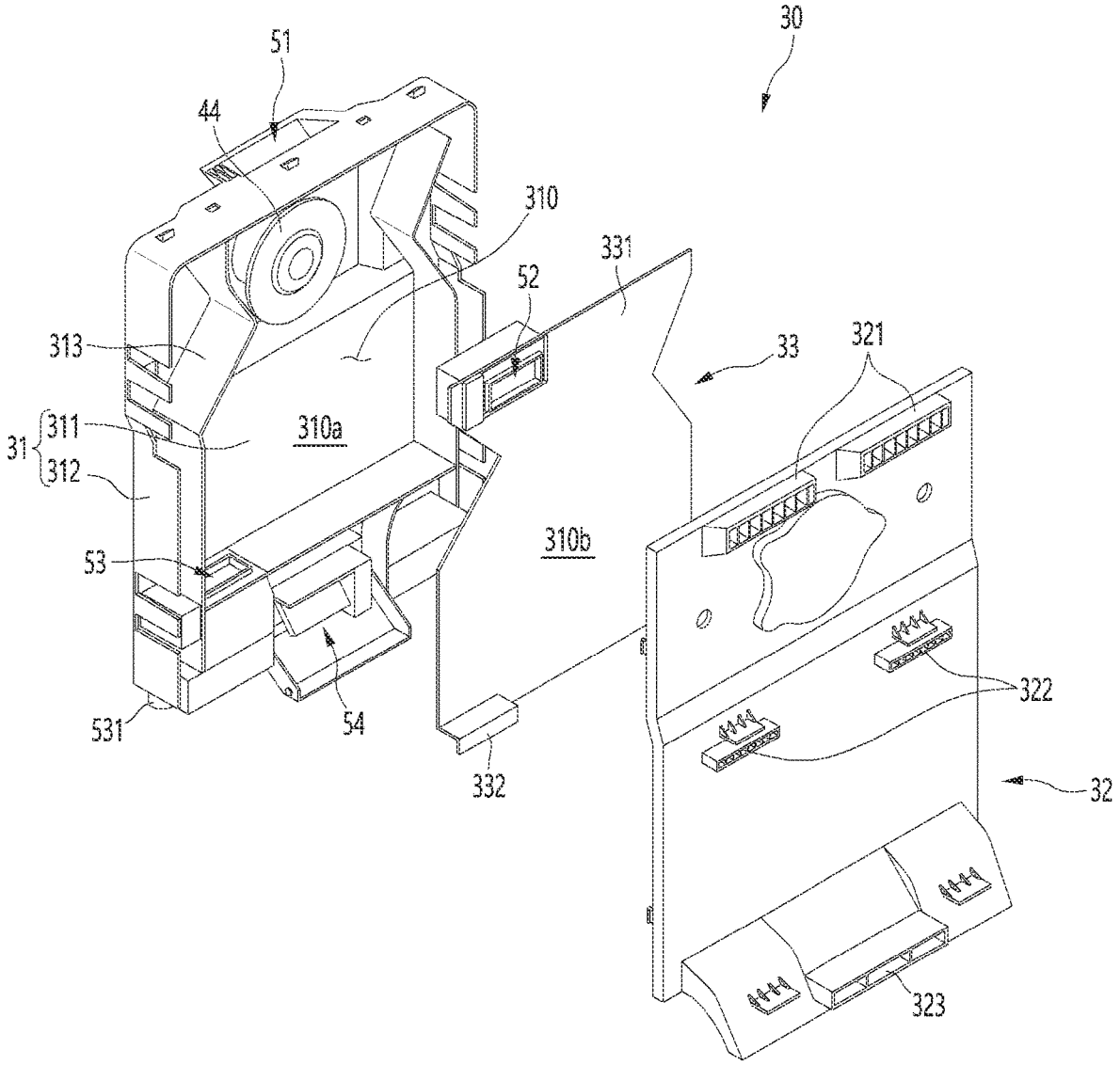
FIG. 5 is an exploded perspective view illustrating the grill pan assembly.
Figure 6:
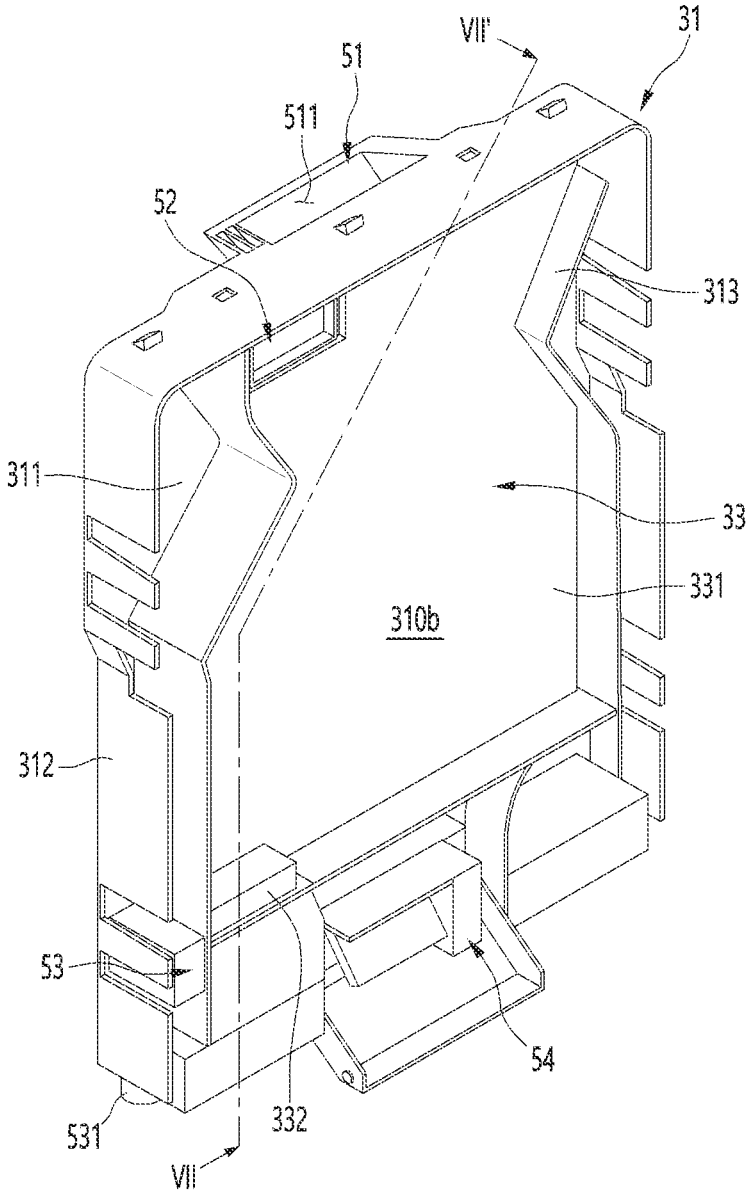
FIG. 6 is a perspective view illustrating a state where the grill pan of the grill pan assembly is separated.
Figure 7:
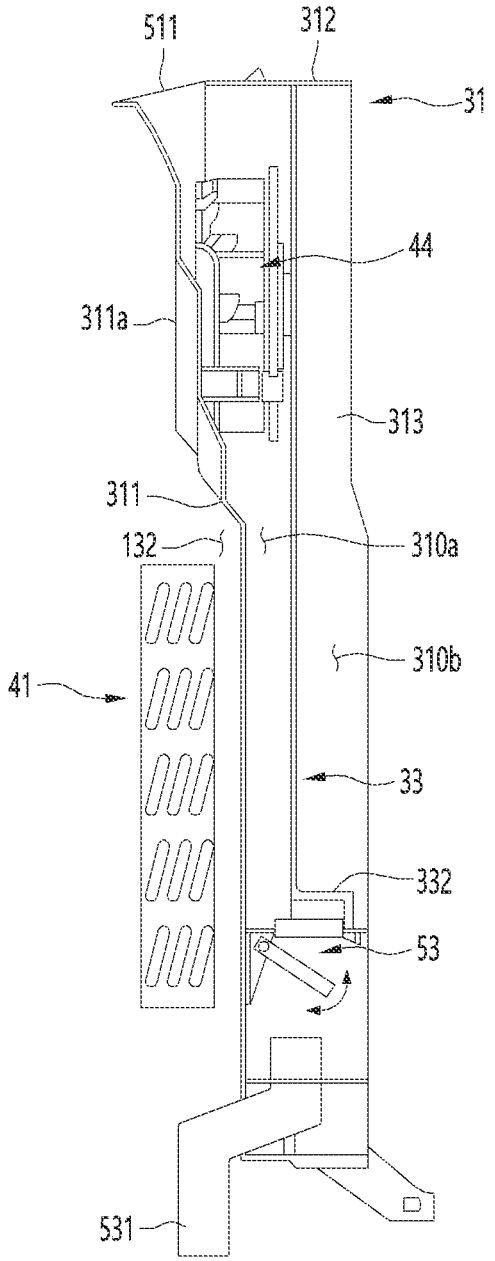
FIG. 7 is a cross-sectional view taken along line VII-VII' of FIG. 6.
Figure 8:
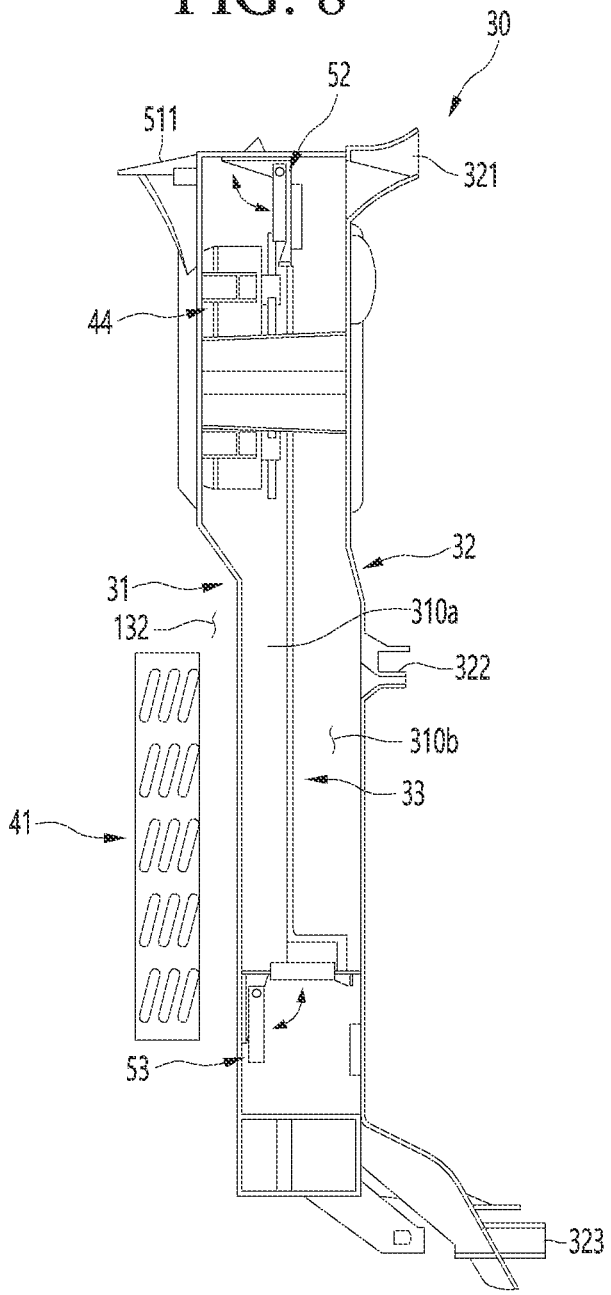
FIG. 8 is a longitudinal cross-sectional view illustrating the grill pan assembly.

FIG. 4 is a perspective view illustrating a grill pan assembly of the refrigerator, FIG. 5 is an exploded perspective view illustrating the grill pan assembly, FIG. 6 is a perspective view illustrating a state where the grill pan of the grill pan assembly is separated, FIG. 7 is a cross-sectional view taken along line VII-VII' of FIG. 6, and FIG. 8 is a longitudinal cross-sectional view illustrating the grill pan assembly.

As illustrated in the drawing, the grill pan assembly 30 may be formed to have a size corresponding to the size of the rear surface of the freezing chamber 13, and may have an approximately rectangular front shape to partition the space in the freezing chamber 13 in the front and rear directions. In addition, the grill pan assembly 30 may be formed to have a predetermined width in the front and rear direction so that the fan 44 in the refrigerator is accommodated therein and a flow path of cold air is formed.

As a whole, the grill pan assembly 30 may includes a case 31 having an open front, a grill pan 32 shielding the open front of the case 31, and a partition 33 partitioning the inner space of the case 31 in the front and rear direction.

In detail, the case 31 may include a case plate 311 forming a rear surface and a case flange 312 extending forward along the circumference of the case plate 311. The case plate 311 may form a rear surface of the grill pan assembly 30, and the case flange 312 may form a circumferential surface of the grill pan assembly 30.

An upper portion of the case plate 311 may be stepped backward to form a space in which the fan 44 in the refrigerator can be accommodated. In addition, an inlet 311*a* through which air flows toward the fan 44 in the refrigerator may be opened at a position corresponding to the fan 44 in the refrigerator. The fan 44 in the refrigerator may be formed to have a centrifugal fan structure that suctions in air in an axial direction and discharges air in a circumferential direction.

In addition, a refrigerating chamber side opening 511 may be formed at an upper end of the case plate 311. The refrigerating chamber side opening 511 is a passage for supplying cold air to the refrigerating chamber 12 and may be opened and closed by the refrigerating chamber damper 51. The refrigerating chamber side opening 511 may be provided on the upper surface of the grill pan assembly 30 and may be formed to protrude rearward. In addition, the refrigerating chamber side opening 511 may be formed to communicate with a flow path toward the refrigerating chamber 12. In addition, the refrigerating chamber side opening 511 may be opened toward the circumferential surface of the fan 44 in the refrigerator. Accordingly, some of the air discharged in the circumferential direction of the fan 44 in the refrigerator when the fan 44 in the refrigerator is driven may be naturally directed towards the refrigerating chamber side opening 511.

A lower portion of the case plate 311 may protrude forward and be formed to be stepped. Accordingly, the lower portion of the case plate 311 may form a space in which the evaporator 41 may be formed at the rear. Accordingly, the cold air generated by the evaporator 41 may flow through the inlet 311*a* and may flow into the case plate 311 when the fan 44 in the refrigerator is driven.

Meanwhile, the case flange 312 may have a predetermined height, and an air flow space 310 may be formed inside the case 31. The space inside the case 31 may be divided by the partition 33 into a front cold air flow space 310*b* and a rear heated air flow space 310*a*. The front cold air flow space 310*b* and the rear heated air flow space 310*a* are referred to as respectively a front space 130*b* and a rear space 310*a* or a first air flow space 310*b* and a second air flow space 310*a*.

In addition, a flow path forming portion 313 may be formed in the air flow space 310 formed by the case flange 312. The flow path forming portion 313 may protrude from the case plate 311 and form the heating air flow space 310*a*. The flow path forming portion 313 may be spaced apart from both left and right side surfaces of the case flange 312 and may extend downward from an upper end of the case flange 312. In addition, the flow path forming portion 313 may be formed with a lower surface extending to connect the lower ends of the left and right side surfaces. The flow path forming portion 313 may be formed along the circumference of the partition 33.

In addition, the flow path forming portion 313 may be formed to be symmetrical to both left and right sides with respect to the center line of the case 31. In addition, the flow path forming portion 313 is formed to have a narrow width at a position corresponding to the fan 44 in the refrigerator, and air discharged in the circumferential direction of the fan 44 in the refrigerator by driving the fan 44 in the refrigerator may be directed upward and downward.

Meanwhile, the flow path forming portion 313 may be formed to be lower than the protrusion height of the case flange 312. In addition, the extended end portion of the flow path forming portion 313 may be in contact with the circumference of the partition 33. In other words, the heating air flow space 310*a* may be defined by the case plate 311, the flow path forming portion 313, and the partition 33.

In addition, a machine room exhaust damper 53 may be provided on one side of the lower surface of the flow path forming portion 313. The machine room exhaust damper 53 may communicate with the exhaust member 531. Accordingly, the exhaust member 531 may be opened and closed according to the operation of the machine room exhaust damper 53, and the heated air flow space 310*a* and the inside of the machine room 20 may be selectively communicated with each other.

The exhaust member 531 may be connected to the machine room exhaust damper 53 and may be formed in a tubular shape extending further downward from the heated air flow space 310*a* through the lower surface of the grill pan assembly 30. In addition, the exhaust member 531 may be bent so as to penetrate and extend above a region of the machine room 20, in which the condenser 22 is disposed.

In addition, a freezing chamber suction damper 54 may be provided on a lower surface of the flow path case 31. The freezing chamber suction damper 54 may be configured to selectively determine the inflow of air into the freezing chamber 13. The freezing chamber suction damper 54 may communicate with the cold air suction port 323, and may communicate with the cold air flow space 310*b* inside the case 31. In other words, the air inside the freezing chamber 13 may flow into the cold air flow space 310*b* according to whether the freezing chamber suction damper 54 is opened or closed.

The partition 33 is provided inside the case 31, and may be coupled to the circumference of the flow path forming portion 313. The partition 33 may be formed in a plate shape, and may form a front surface of the heated air flow space 310*a* in a state where the partition is coupled to the flow path forming portion 313.

The partition 33 may include a plate portion 331 forming the heating air flow space 310*a* and a discharge flow path portion 332 at a lower end of the plate portion 331. The plate portion 331 may be formed in a plate shape and may be in contact with the circumference of the flow path forming portion 313.

The plate portion 331 may form the remaining region except for the flow path forming portion 313 and may substantially partition the air flow space 310 inside the case 31 in the front and rear direction. In addition, the upper end of the plate portion 331 is in contact with the upper end of the case flange 312 of the flow path case 31, and both ends in the left and right direction and the lower end can be formed to be in contact with both ends and the lower end of the flow path forming portion 313, respectively. Accordingly, the front surface of the heating air flow space 310*a* and the rear surface of the cold air flow space 310*b* may be defined by the plate portion 331.

The discharge flow path portion 332 may be formed at a lower end of one side of the plate portion 331. The discharge flow path portion 332 may be formed at a position corresponding to the machine room exhaust damper 53 and may be bent forward from the upper side of the machine room exhaust damper 53 to form a space so that the air of the heated air flow space 310*a* smoothly flows into the machine room exhaust damper 53.

A freezing chamber discharge damper 52 may be provided at one upper end of the partition 33. One side of the freezing chamber discharge damper 52 may be opened toward the fan 44 in the refrigerator, and the other side thereof may be opened toward the cold air flow space 310*b*. The freezing chamber discharge damper 52 may be opened or closed according to the operating state of the refrigerator 1, and the air discharged by the driving of the fan 44 in the refrigerator according to the opening and closing of the freezing chamber discharge damper 52 can be selectively supplied. In other words, when the freezing chamber discharge damper 52 is opened, the air discharged by the fan 44 in the refrigerator may be guided into the freezing chamber 13 through the cold air flow space 310*b*.

When the partition 33 is mounted, the partition 33 may shield the fan 44 in the refrigerator. The fan 44 in the refrigerator may have a structure in which a fan and a motor are combined, and if necessary, the fan and the motor may be mounted in a separate case to be configured in a module state.

When the partition 33 is mounted, a cold air flow space 310*b* may be formed in front of the partition 33. The cold air flow space 310*b* may provide a space in which the cold air supplied by the fan 44 in the refrigerator flows into the freezing chamber 13 through the grill pan 32.

The grill pan 32 forms a front surface of the grill pan assembly 30, and forms a surface exposed to the inside of the freezing chamber 13 when the grill pan assembly 30 is mounted in the freezing chamber 13, and the shape of the rear wall of the storage space inside the freezing chamber 13 may be formed.

An upper cold air discharge port 321 may be formed at the upper end of the grill pan 32, and an intermediate cold air discharge port 322 may be formed below the upper cold air discharge port 321, that is, in the middle region of the grill pan 32. The upper cold air discharge port 321 and the intermediate cold air discharge port 322 may communicate with the cold air flow space 310*b*. Accordingly, the cold air supplied to the cold air flow space 310*b* may be effectively supplied to the inside of the refrigerator through the upper cold air discharge port 321 and the intermediate discharge port 322.

Meanwhile, a cold air suction port 323 through which air from the freezing chamber 13 is suctioned may be formed in the center of the lower end of the grill pan 32. The cold air suction port 323 may be formed at a position corresponding to the freezing chamber suction damper 54. Accordingly, according to the opening and closing of the freezing chamber suction damper 54, the air in the freezing chamber 13 may communicate with the heat exchange space 132 in which the evaporator 41 is accommodated through the cold air suction port 323.

At this time, the freezing chamber suction damper 54 may be opened further below the lower end of the evaporator 41, and therefore, when the fan 44 in the refrigerator is driven, the air flowing through the freezing chamber suction damper 54 may flow upward after being cooled completely through the evaporator 41.

Hereinafter, the operation of the refrigerator 1 having the above structure will be described with reference to the drawings.

Figure 9:
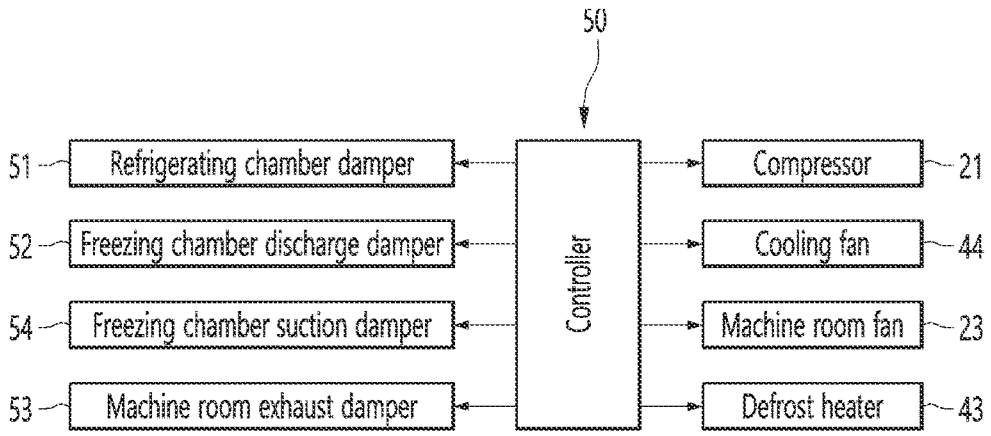
FIG. 9 is a block diagram illustrating a connection relationship of the controller of the refrigerator.
Figure 10:
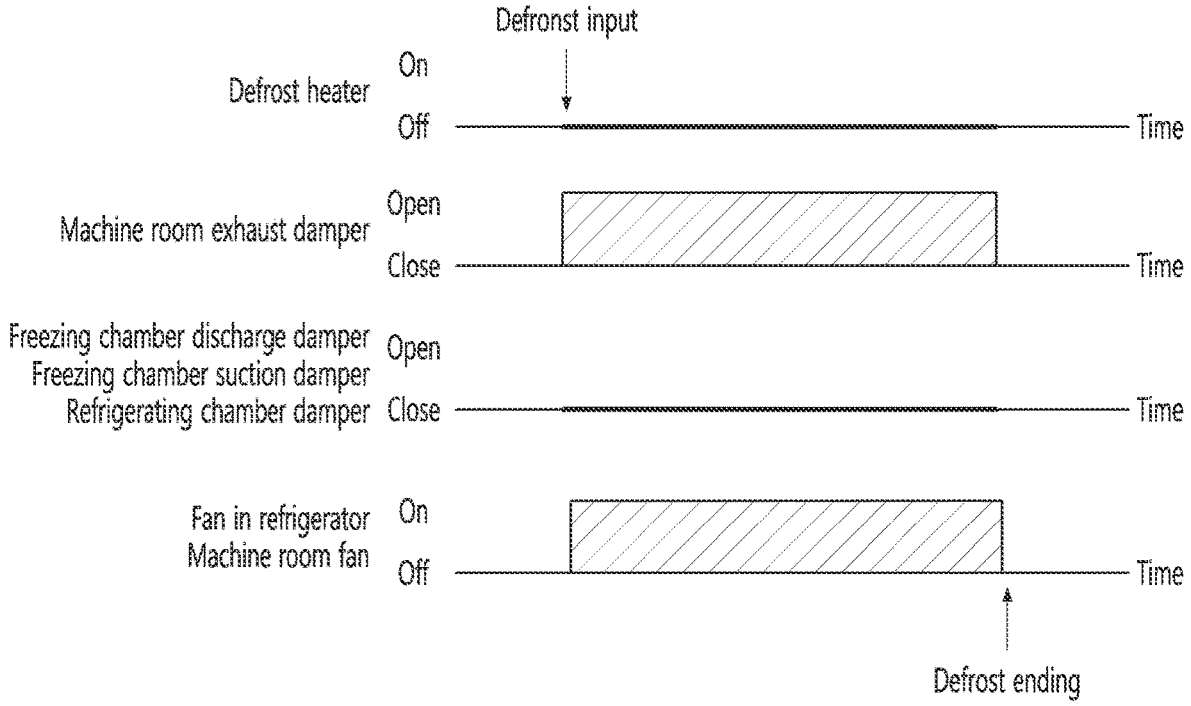
FIG. 10 is a view illustrating operating states of main components during a defrosting operation.
Figure 11:
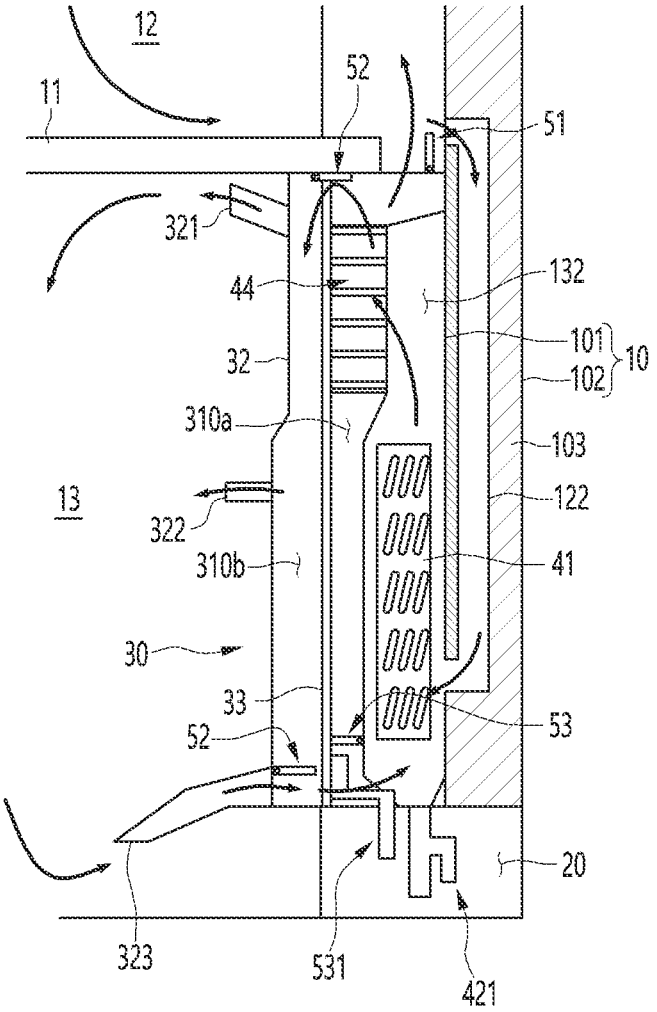
FIG. 11 is a view illustrating the flow of cooling air during normal operation.
Figure 12:
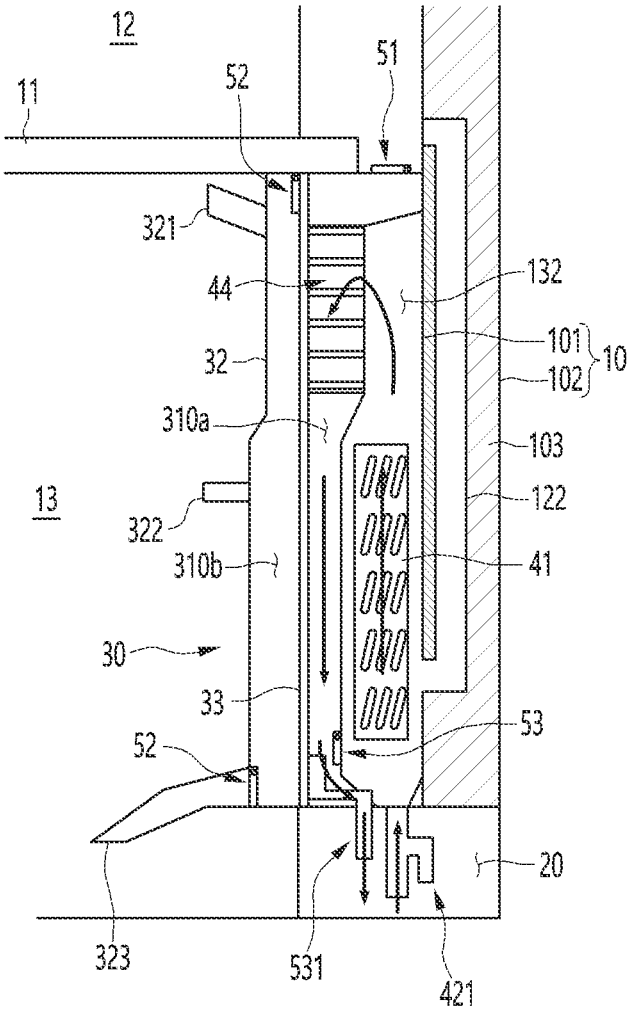
FIG. 12 is a view illustrating the flow of heating air during a defrosting operation.

FIG. 9 is a block diagram illustrating a connection relationship of the controller of the refrigerator, FIG. 10 is a view illustrating operating states of main components during a defrosting operation, FIG. 11 is a view illustrating the flow of cooling air during normal operation, and FIG. 12 is a view illustrating the flow of heating air during a defrosting operation.

As illustrated in the drawing, the controller 50 controls the operation of the compressor 21 and the fan 44 in the refrigerator to cool the space in the refrigerator to a set temperature.

The operating state for cooling the refrigerating chamber 12 or the freezing chamber 13 may be referred to as a normal operating state. The air circulation structure during normal operation is illustrated in FIG. 11.

In detail, the compressor 21 and the fan 44 in the refrigerator may be driven to cool the storage space. By driving the compressor 21, the refrigerant may be supplied to the evaporator 41 through the condenser 22 and the expansion device. In addition, the evaporator 41 may be in a low temperature state while the liquid refrigerant is vaporized.

In addition, the air inside the freezing chamber 13 may flow into the heat exchange space 132 by the driving of the fan 44 in the refrigerator and may be cooled while passing through the evaporator 41. To this end, the freezing chamber suction damper 54 may be opened, and the air inside the freezing chamber 13 flowing through the cold air suction port 323 of the grill pan 32 flows below the evaporator 41 and flows upward along the evaporator 41.

The air flowing upward in the heat exchange space 132 may be suctioned in an axial direction of the fan 44 in the refrigerator and discharged in a circumferential direction of the fan 44 in the refrigerator. At this time, the freezing chamber discharge damper 52 may be controlled in an open state. Accordingly, cold air may be supplied to the cold air flow space 310*b* by driving the fan 44 in the refrigerator, and the cold air may be supplied into the freezing chamber 13 through the cold air discharge ports 321 and 322 formed in the grill pan 32, cold air is supplied to the inside of the freezing chamber 13 through the cold air discharge port 321, 322 formed in the grill pan 32, and thus can cool the freezing chamber 13.

Meanwhile, the cold air generated by the evaporator 41 may be supplied to the refrigerating chamber 12 to cool the refrigerating chamber 12.

In detail, the controller 50 may open the refrigerating chamber damper 51 to cool the refrigerating chamber 12. When the fan 44 in the refrigerator is driven while the refrigerator compartment damper 51 is open, the cool air cooled while passing through the evaporator 41 may be suctioned in the axial direction of the fan 44 in the refrigerator and then discharged in the circumferential direction.

Accordingly, the cold air discharged above the cold air flow space 310*b* flows toward the refrigerating chamber 12 through the open refrigerating chamber damper 51 and the refrigerating chamber side opening 511. In this case, the refrigerating chamber side opening 511 is connected to a discharge duct (not illustrated) inside the refrigerating chamber 12 to supply cold air into the refrigerating chamber 12.

The cold air supplied into the refrigerating chamber 12 and cooled in the refrigerating chamber 12 can be inhaled again toward the evaporator 41 through a suction duct 122 connected to communicate between the refrigerating chamber 12 and the heat exchange space 132. Although not illustrated, a damper may be provided in the suction duct 122 to selectively adjust suction of cool air in the refrigerating chamber 12 into the heat exchange space 132. The cooling of the refrigerating chamber 12 may be achieved by such a cooling air circulation structure.

Meanwhile, in the process of cooling the refrigerating chamber 12 and the freezing chamber 13, frost may be formed on the evaporator 41. In addition, when a defrost input signal is input, the controller 50 may remove the frost from the evaporator 41 or a position adjacent to the evaporator 41 through a defrosting operation.

For the defrosting operation, the controller 50 may allow the high-temperature air inside the machine room 20 to flow into the heat exchange space 132, and the air flowing into the heat exchange space 132 may be returned again to the machine room 20 through the heating air flow space 310*a*. In order to provide such an air circulation path, the controller 50 opens the machine room exhaust damper 53 and closes all the freezing chamber suction damper 54, the freezing chamber discharge damper 52, and the refrigerating chamber damper 51, and thus the controller can prevent high-temperature air from affecting the temperature inside the refrigerating chamber 12 or the freezing chamber 13 by flowing of the high-temperature air into the refrigerating chamber 12 or the freezing chamber 13.

In addition, the fan 44 in the refrigerator and the machine room fan 23 are driven so that the air in the machine room 20 sequentially circulates through the heat exchange space 132 and the heated air flow space 310*a*. At this time, the defrost heater 43 may be turned off. Of course, the defrost heater 43 may not be provided. In addition, even if the defrost heater 43 is operated, the defrost heater may be operated at a temperature lower than the temperature of a normal defrosting operation, or may be operated only in some section of the entire defrosting operation section.

A circulation structure of heated air during the defrosting operation will be described with reference to FIG. 12.

When the compressor 21 is driven for cooling in the refrigerator, the temperature inside the machine room 20 increases due to heat generated by the compressor 21 and heat radiation from the condenser 22. In addition, when the machine room fan 23 is driven, air is forced to flow from the condenser 22 side to the compressor 21 side.

In addition, in a state where the freezing chamber suction damper 54, the freezer chamber discharge damper 52, the refrigerating chamber damper 51 are closed, and the machine room exhaust damper 53 is open, when fan 44 in the refrigerator is driven, a negative pressure is generated in the heat exchange space 132, and air inside the machine room 20 flows into the heat exchange space 132 through the drain hose 421.

The high-temperature air inside the machine room 20 flows into the heat exchange space 132 through the lower surface of the heat exchange space 132 and moves upward through the evaporator 41, and, in this process, can melt the frost formed on the evaporator 41. In other words, as the high-temperature air inside the machine room 20 is continuously supplied, the temperature inside the heat exchange space 132 including the evaporator 41 increases to remove the frost.

Then, the air that has passed through the evaporator 41 passes through the fan 44 in the refrigerator and flows into the heated air flow space 310*a*. In addition, the machine room exhaust damper 53 is in an open state on the lower surface of the heated air flow space 310*a*, and the condenser 22 side of the machine room 20 to which the outlet of the exhaust member 531 is exposed is in a negative pressure state by driving of the machine room fan 23 so that the air in the heated air flow space 310*a* can be discharged into the machine room 20.

As such, the high-temperature air inside the machine room 20 can be continuously supplied to pass through the evaporator 41 by driving the machine room fan 23 and the fan 44 in the refrigerator, and the air passing through the evaporator 41 may be discharged to the machine room 20 through the heating air flow space 310*a*. The frost formed on the evaporator 41 can be melted by the circulation of the air in the machine room 20 as described above.

The controller 50 performs a defrosting operation until a set condition is satisfied. For example, the controller 50 performs the defrosting operation for a set time, and when the defrosting operation is ended by inputting the ending of the defrost to the controller, the controller 50 closes the machine room exhaust damper 53, and opens the freezing chamber discharge damper 52, the freezing chamber suction damper 54, and the refrigerating chamber damper 51 according to operating conditions so that the inside of the refrigerator can be cooled again.

INDUSTRIAL APPLICABILITY

The refrigerator according to the embodiment of the present disclosure has high industrial applicability because power consumption can be reduced.

The invention claimed is:

1. A refrigerator comprising:

a cabinet that defines (i) a storage space, (ii) a heat exchange space that accommodates an evaporator, and (iii) a machine room that accommodates a compressor and a condenser;

a grill pan assembly that is provided in the cabinet and that separates the storage space and the heat exchange space from each other; and an air suction passage configured to fluidly connect the heat exchange space with the machine room, wherein the grill pan assembly includes:

a case that is in fluid communication with the heat exchange space, a fan provided in the case, a grill pan provided on a front surface of the case, the grill pan having a cold air discharge port and a cold air suction port, an exhaust passage configured to fluidly connect the case with the machine room, an exhaust damper provided in the case and configured to open and close the exhaust passage, and a partition provided in an inside of the case, wherein the partition partitions the inside of the case into (i) a first space that defines a first flow path configured to carry air circulating between the heat exchange space and the storage space and (ii) a second space that defines a second flow path configured to heat air circulating between the machine room and the heat exchange space, wherein the case includes:

a case plate that defines a rear surface of the case, a case flange that extends forward from the case plate and that is disposed along a circumference of the case plate, and a flow path forming portion that is spaced apart from the case flange, that protrudes forward from the case plate, and that is covered by the partition, and wherein a protrusion height of the flow path forming portion from the case plate is less than a protrusion height of the case flange from the case plate.

2. The refrigerator of claim 1, wherein the first space is defined at a front side of the partition, and the second space is defined at a rear side of the partition.

3. The refrigerator of claim 1, wherein the fan is positioned inside the flow path forming portion.

4. The refrigerator of claim 3, wherein the partition has a shape corresponding to the flow path forming portion and is coupled to an end portion of the flow path forming portion to shield the second space.

5. The refrigerator of claim 1, wherein the exhaust damper is configured to maintain a closed state during a cooling operation in which the compressor is driven, and configured to be opened during a defrosting operation for defrosting of the evaporator.

6. The refrigerator of claim 5, wherein the partition comprises a discharge damper that selectively enables fluid communication between the first space and the second space, and wherein the discharge damper is configured to be closed during the defrosting operation and configured to be opened during the cooling operation.

7. The refrigerator of claim 5, wherein the case further comprises a suction damper configured to open and close the cold air suction port, and wherein the suction damper is configured to be closed during the defrosting operation and configured to be opened during the cooling operation.

8. The refrigerator of claim 5, further comprising a machine room fan that is provided in the machine room and that is configured to cool the compressor and the condenser, wherein the machine room fan is configured to be driven during the defrosting operation, and wherein an inlet of the air suction passage is positioned at a discharge side of the machine room fan, and an outlet of the exhaust passage is positioned at a suction side of the machine room fan.

9. The refrigerator of claim 8, wherein both the fan and the machine room fan are configured to be driven during the defrosting operation.

10. The refrigerator of claim 1, wherein the partition has a discharge flow path portion that is defined at a position corresponding to the exhaust damper and that is configured to guide air flow to the exhaust damper.

11. The refrigerator of claim 1, wherein the partition is provided with a discharge damper, wherein, when the fan is driven while the discharge damper is open, the cold air generated by the evaporator passes through the first space and the storage space and flows into the heat exchange space, and wherein, when the fan is driven while the discharge damper is closed, the air in the machine room flows into the machine room through the evaporator and the second space.

12. The refrigerator of claim 1, further comprising a defrost water receiver disposed in the machine room and configured to store defrost water, wherein the air suction passage extends toward the defrost water receiver.

13. The refrigerator of claim 1, wherein the exhaust passage is fluidly connected with the second space and the machine room.

14. The refrigerator of claim 1, wherein an outlet of the exhaust passage is positioned above the condenser.

15. The refrigerator of claim 1, wherein the cabinet includes:

a refrigerating chamber, and a freezing chamber which is disposed below the refrigerating chamber, and wherein the evaporator and the grill pan assembly are provided in the freezing chamber.

16. The refrigerator of claim 15, wherein the grill pan assembly extends from an upper surface of the freezing chamber to an upper surface of the machine room.

17. The refrigerator of claim 15, wherein the case defines a refrigerating chamber side opening that is in fluid communication with the refrigerating chamber and that is configured to supply cold air to the refrigerating chamber, wherein the refrigerator further comprises a refrigerating chamber damper configured to open and close the refrigerating chamber side opening, and wherein the refrigerating chamber damper is configured to maintain a closed state during a defrosting operation for defrosting the evaporator.

18. The refrigerator of claim 15, wherein the cabinet is provided with a suction duct that enables fluid communication between the refrigerating chamber and the heat exchange space such that air in the refrigerating chamber is directed to the evaporator.

19. The refrigerator of claim 18, wherein the suction duct is disposed behind the evaporator.

20. A refrigerator comprising:

a cabinet that defines (i) a storage space that includes a refrigerating chamber and a freezing chamber disposed below the refrigerating chamber, (ii) a heat exchange space that accommodates an evaporator, and (iii) a machine room that accommodates a compressor and a condenser;

a grill pan assembly that is provided in the cabinet and that separates the storage space and the heat exchange space from each other; and an air suction passage configured to fluidly connect the heat exchange space with the machine room, wherein the grill pan assembly includes:

a case that is in fluid communication with the heat exchange space, a fan provided in the case, a grill pan provided on a front surface of the case, the grill pan having a cold air discharge port and a cold air suction port, an exhaust passage configured to fluidly connect the case with the machine room, an exhaust damper provided in the case and configured to open and close the exhaust passage, and a partition provided in an inside of the case, wherein the partition partitions the inside of the case into (i) a first space that defines a first flow path configured to carry air circulating between the heat exchange space and the storage space and (ii) a second space that defines a second flow path configured to heat air circulating between the machine room and the heat exchange space, wherein the evaporator and the grill pan assembly are provided in the freezing chamber, and wherein the grill pan assembly extends from an upper surface of the freezing chamber to an upper surface of the machine room.

* * * * *